US005282568A

United States Patent [19]

File

[11] Patent Number: 5,282,568

[45] Date of Patent: Feb. 1, 1994

[54] REUSEABLE MAILER MEETING POSTAL REQUIREMENTS

[75] Inventor: Jerry E. File, Mundelein Lake, Ill.

[73] Assignee: Moore Business Forms, Inc., Grand Island, N.Y.

[21] Appl. No.: 932,955

[22] Filed: Aug. 21, 1992

[51] Int. Cl.[5] ..... B65D 27/06

[52] U.S. Cl. ..... 229/304; 229/305

[58] Field of Search ..... 229/306, 305, 304, 303

[56] References Cited

U.S. PATENT DOCUMENTS

| | | | |
|---|---|---|---|
| 3,221,980 | 12/1965 | Mercur . | |
| 3,550,841 | 12/1970 | Berkkley . | |
| 3,693,869 | 9/1972 | Eaves, Jr. . | |
| 3,820,447 | 6/1974 | Gendron et al. . | |
| 3,843,042 | 10/1974 | Mayne . | |
| 4,190,162 | 2/1980 | Buescher . | |
| 4,245,775 | 1/1981 | Conn . | |
| 4,334,618 | 6/1982 | Buescher . | |
| 4,403,696 | 9/1983 | Newell . | |
| 4,586,611 | 5/1986 | Scalzo . | |
| 4,602,736 | 7/1986 | Barr | 229/306 X |
| 4,632,427 | 12/1986 | Angus . | |
| 4,669,652 | 6/1987 | Seguin . | |
| 4,688,715 | 8/1987 | Barr | 229/306 X |
| 4,705,298 | 11/1987 | Van Malderghem et al. . | |
| 4,706,877 | 11/1987 | Jenkins . | |
| 4,756,468 | 7/1988 | Jenkins . | |
| 4,775,095 | 10/1988 | Emmott . | |
| 4,778,101 | 10/1988 | Paquin . | |
| 4,815,654 | 3/1989 | Buescher . | |
| 4,830,269 | 5/1989 | Jenkins . | |
| 4,896,823 | 1/1990 | Taylor . | |
| 4,944,449 | 7/1990 | Schmidt . | |
| 4,993,624 | 2/1991 | Schlich | 229/303 X |
| 5,110,043 | 5/1992 | Ashby | 229/303 X |
| 5,169,061 | 12/1992 | Buescher | 229/305 |

*Primary Examiner*—Allan N. Shoap
*Assistant Examiner*—Jes F. Pascua
*Attorney, Agent, or Firm*—Nixon & Vanderhye

[57] ABSTRACT

A reuseable mailer type business form has an initial mailing configuration addressed to an outgoing addressee, and a reply mailing configuration addressed to a reply addressee. The mailer complies with the postal requirement that no part of the outgoing address or postage (including postal service applied bar coding) appear on the mailer in the reply configuration. The mailer includes a front opaque ply with at least one cut-out, and at least one removable strip adjacent an edge, including a perforation line. Postage indicia are visible at the upper right-hand corner of the front ply. A rear opaque ply has a fold line adjacent an edge, and coincident with the perforation line of the front ply. A flap is defined between the fold line and the adjacent edge. At least one insert ply (between the front and rear plies) having outgoing address information visible through the cutout when the mailer is in the initial mailing configuration is provided. Various structures are provided for rendering non-viewable all outgoing addressee postage information when the mailer is converted between the initial and reply configurations. Such structure can be a second removable strip adjacent a different edge than the first removable strip, or a second cutout provided in the front ply for viewing the outgoing postage (on the insert ply).

7 Claims, 7 Drawing Sheets

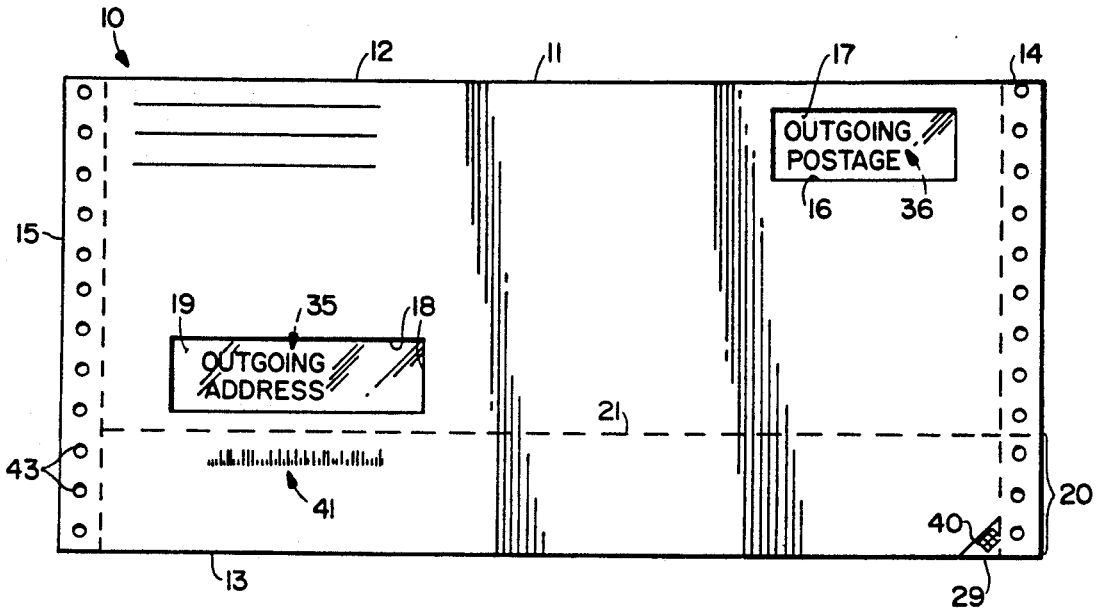
FIG. 1
FIG. 2
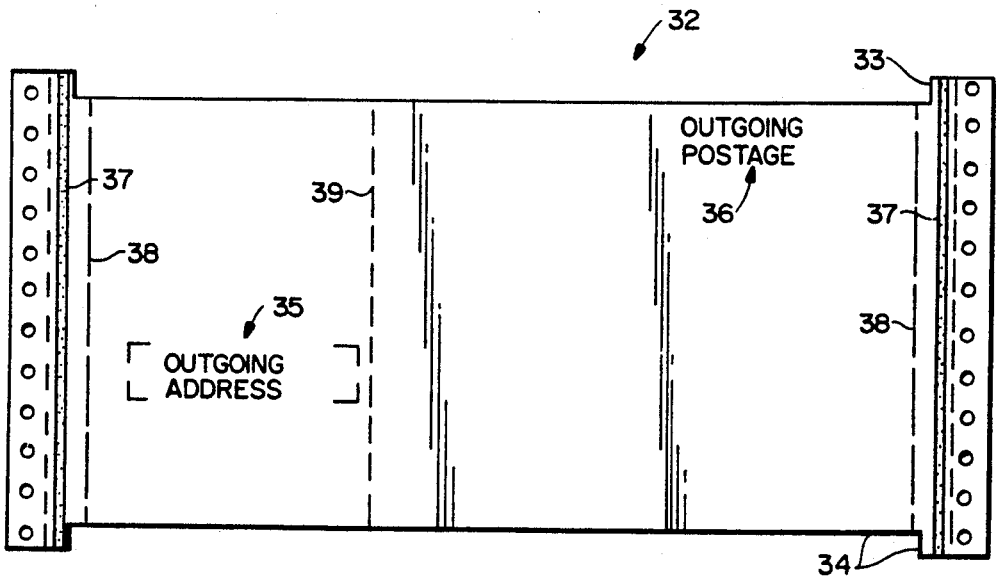

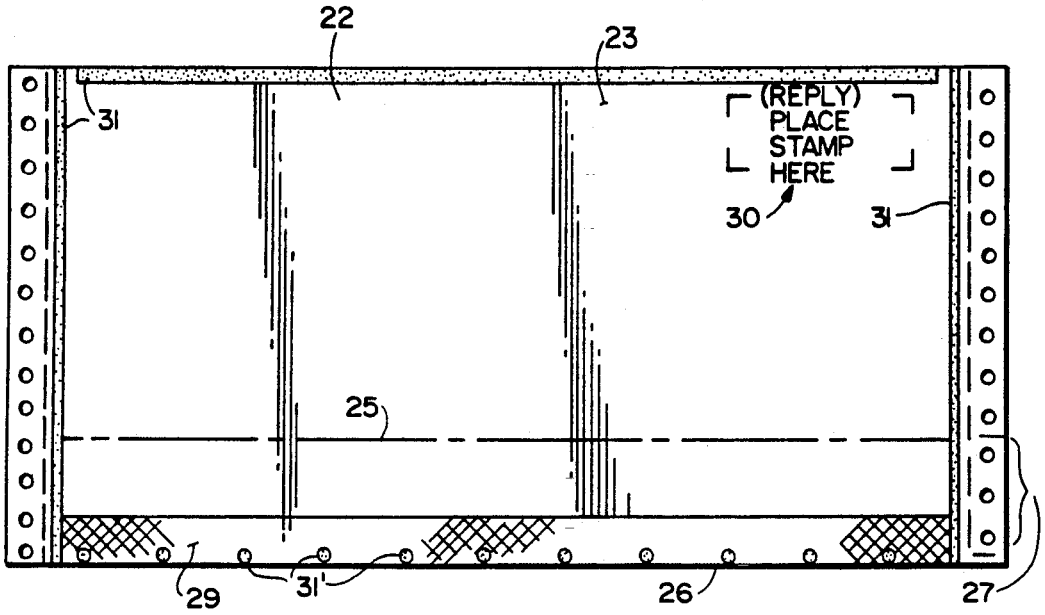
FIG. 3
FIG. 4
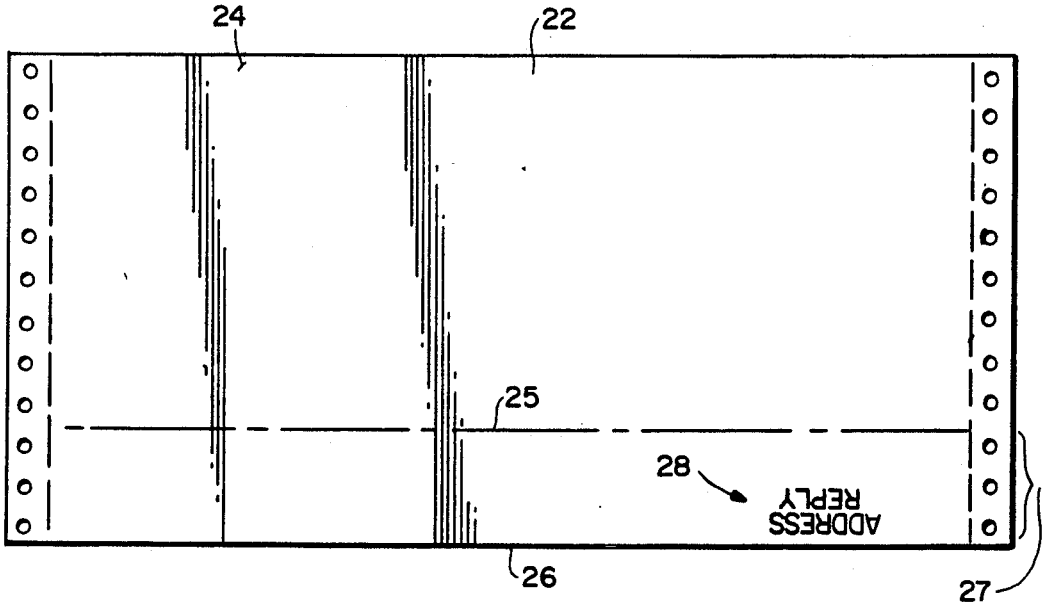

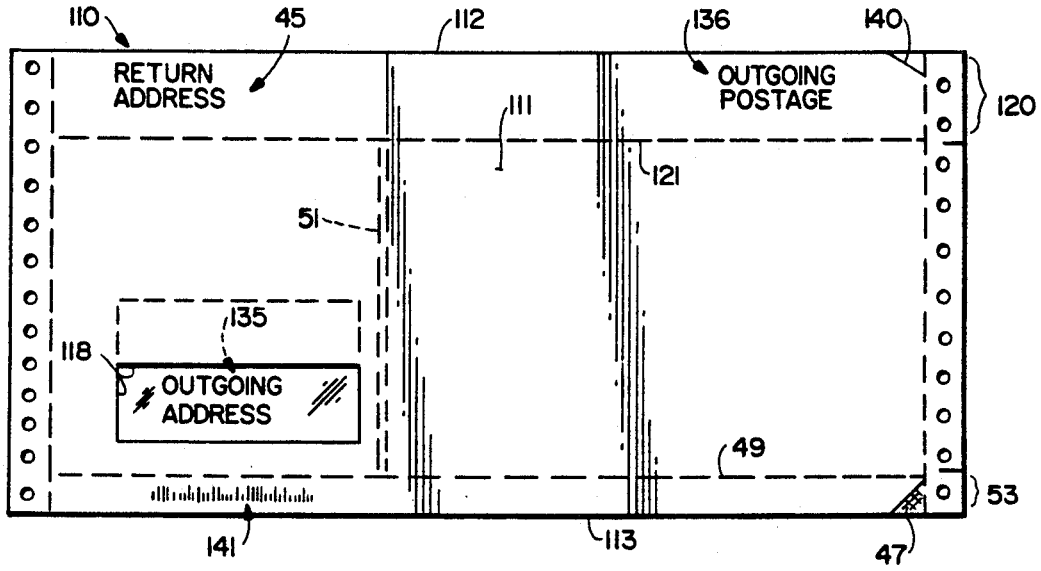
FIG. 5
FIG. 6
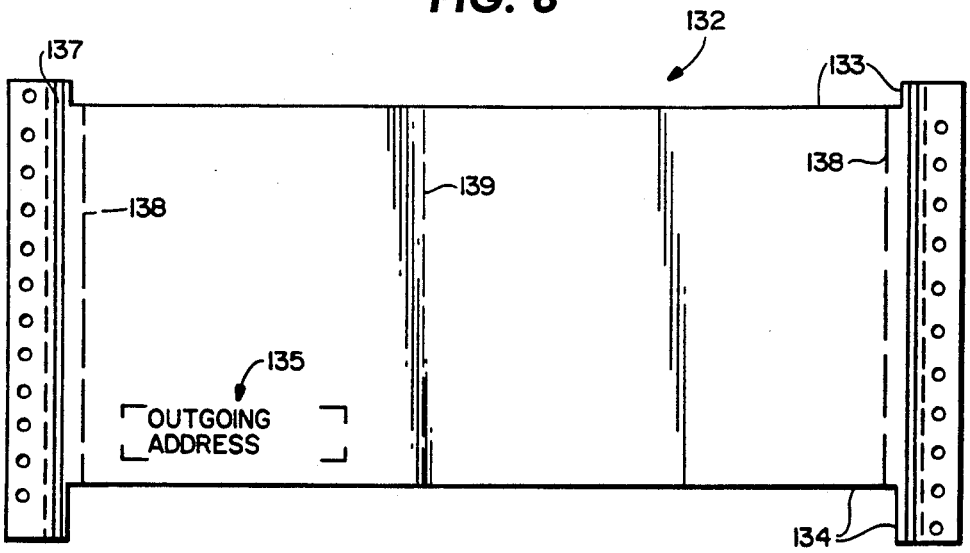

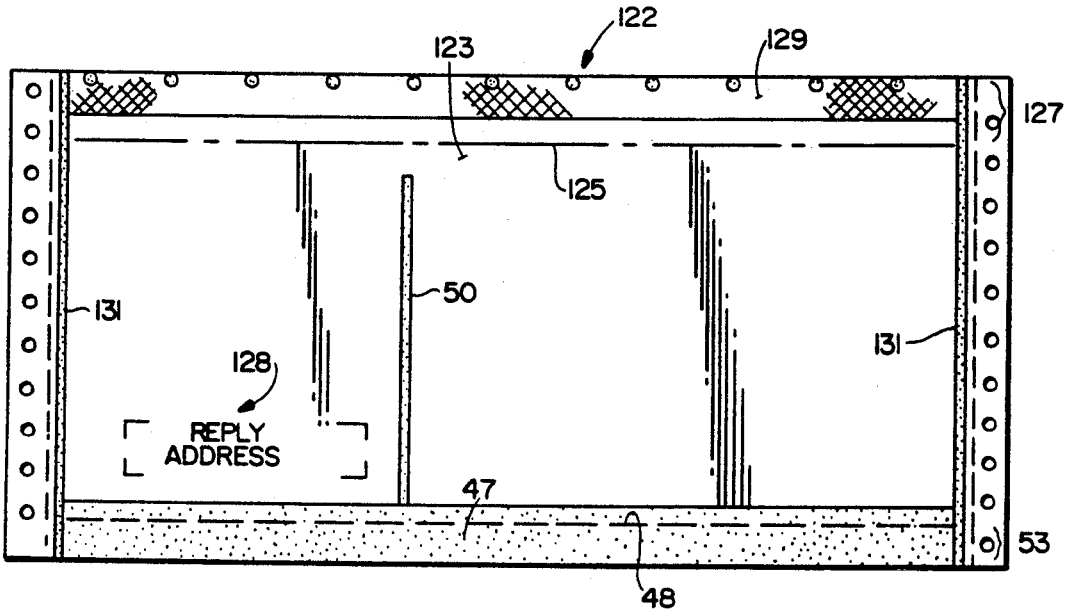
FIG. 7
FIG. 8
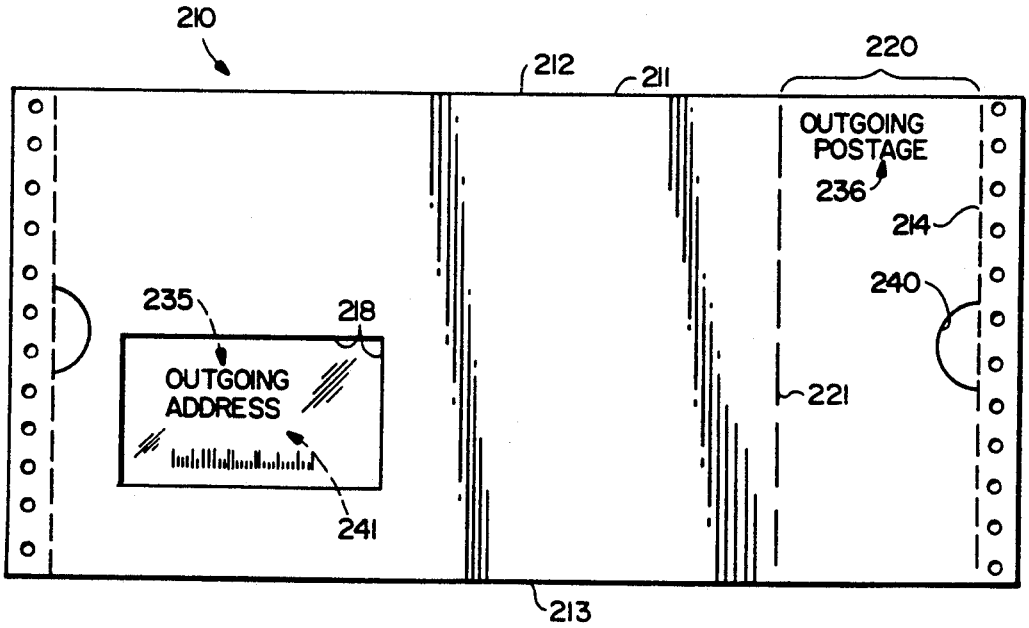

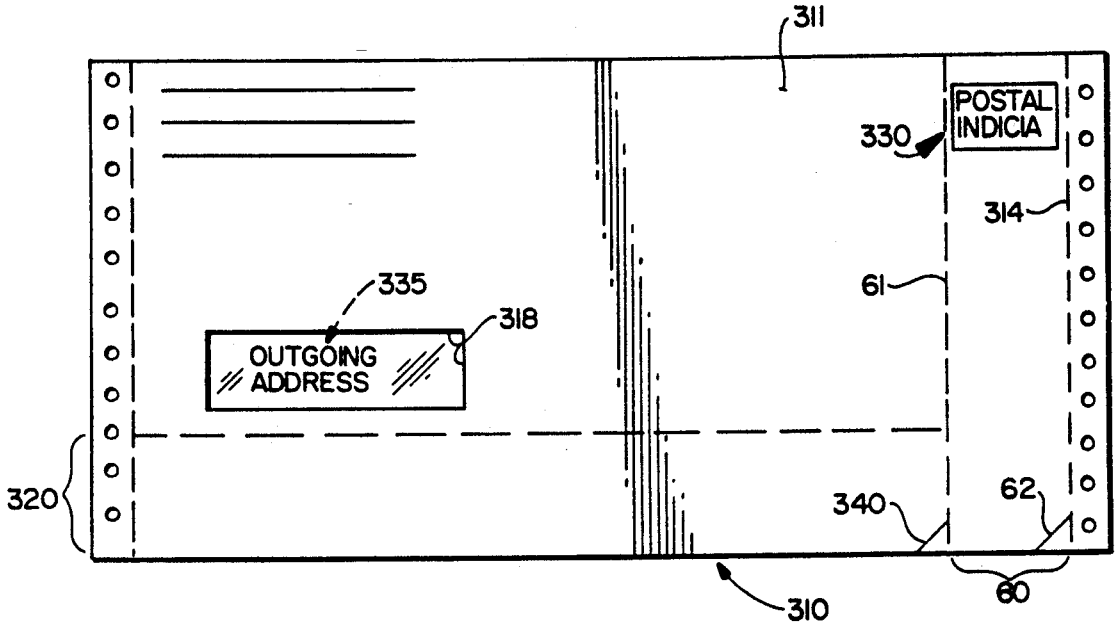
FIG. 12
FIG. 13
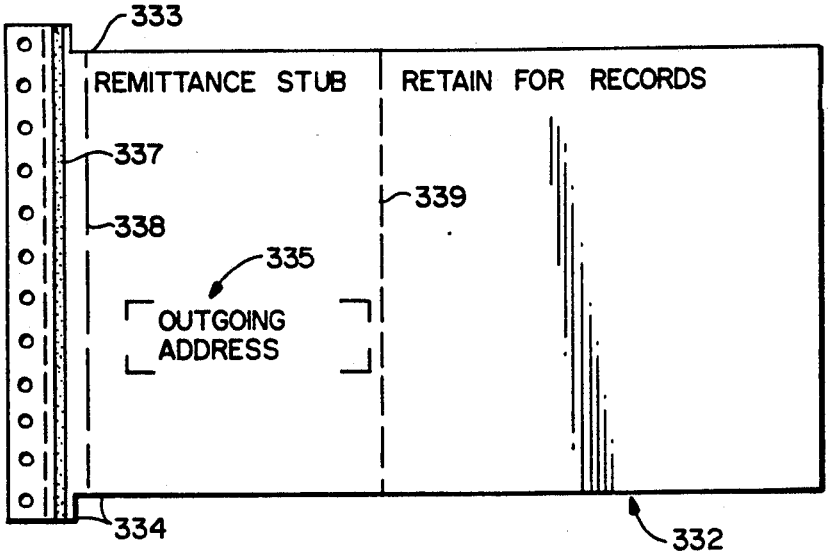

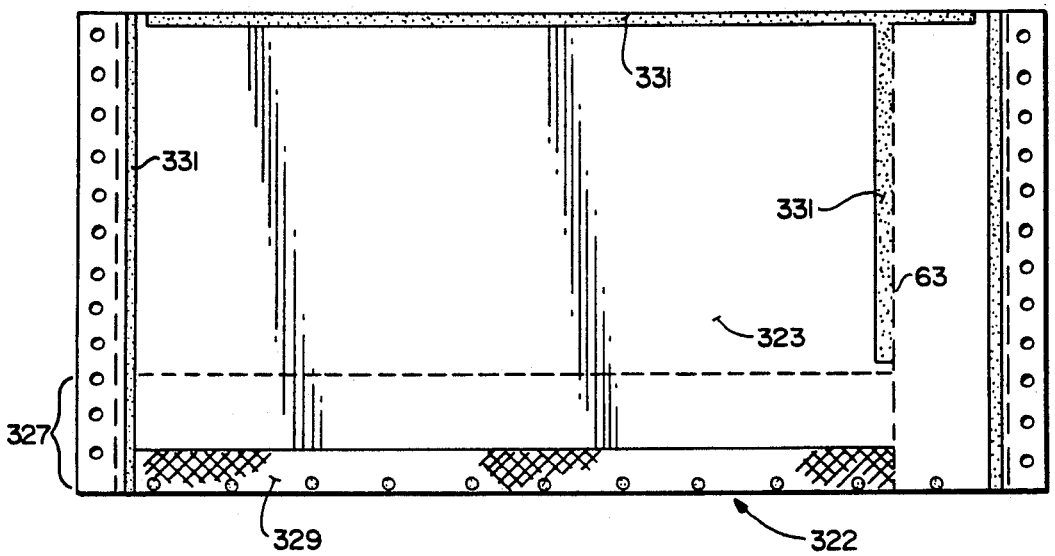
FIG. 14
FIG. 15
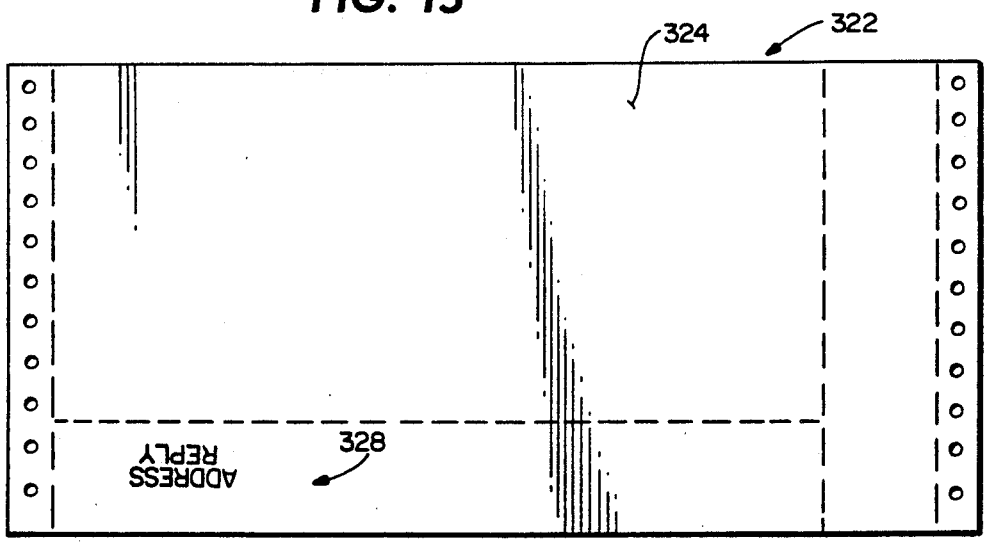

REUSEABLE MAILER MEETING POSTAL REQUIREMENTS

BACKGROUND AND SUMMARY OF THE INVENTION

Relatively-recent postal requirements have rendered unuseable a number of previously-popular mailers. The U.S.P.S. requirements provide that only the addresses, zip+4 bar code, postage and markings and endorsements that may be visible when a reuseable mail piece is mailed from the originator to the recipient, or from the recipient back to the originator, are those that apply at the time of mailing. The mailer must remove or sufficiently obscure any other element to prevent their being mistaken by postal mail process equipment or personnel. Reuseable mail pieces that are not constructed to meet the requirements are not accepted.

According to the present invention, a reuseable mailer type business form, having four different configurations, is provided which complies with the U.S.P.S. regulations. The business form according to the invention comprises a reuseable mailer useable in an initial mailing configuration addressed to an outgoing addressee, and in a reply mailing configuration addressed to the reply addressee. The features common to all mailers according to the invention include the following elements: A front opaque ply having top, bottom and first and second side edges, at least one cutout, and at least one removable strip adjacent an edge thereof including a perforation line. Postage indicia visible at the upper right hand corner of the front ply. A rear opaque ply of substantially the same size as the front ply having a rear face and a front face, and a fold line adjacent an edge thereof substantially coincident with the perforation line of the front ply, a flap portion defined between the fold line and the adjacent edge of the rear ply. At least one insert ply having outgoing address information thereon visible through the cutout when the mailer is in the initial mailing configuration. And, means for rendering non-viewable all outgoing addressee and postage information, including outgoing addressee bar coding, when converting the mailer from the initial configuration to the reply configuration.

The "rendering" means provided according to the present invention may take the form of a second removable strip adjacent a different edge than the at least one removable strip, or a second cutout formed in the front ply at the upper right-hand corner, postage indicia formed on the insert and visible through the second cutout when the mailer is in its initial configuration. Alternatively, the rendering means may include outgoing addressee bar coding on the insert, and the cutout being large enough so that the entire outgoing address, including bar coding, is visible through it. Also, in one embodiment in order to prevent an insert from moving around within the reply configuration of the mailer, an obscuring reply address that is provided on the front face of the rear ply, aligned strips of self-stick adhesive may extend between the top and bottom edges of the front and rear plies on one side of the cutout, for sealing the front and rear plies together when the insert plies are between them. The adhesive on the flap portion may be a strip of rewettable adhesive, and the cutouts may be open or covered by transparent (e.g., glassine) patches.

It is a primary object of the present invention to provide a general configuration of reuseable mailer, and a number of specific embodiments thereof, that are simple to construct and use, yet comply with all postal regulations regarding visibility of outgoing and reply addresses. This and other objects of the invention will become clear from an inspection of the detailed description of the invention and the appended claims.

BRIEF DESCRIPTION OF THE DRAWINGS

FIG. 1 is a top plan view of the front ply of a first embodiment of reuseable mailer according to the present invention;

FIG. 2 is a top plan view of an insert ply of the mailer of the first embodiment;

FIG. 3 is a top plan view of the rear ply of the mailer of the first embodiment;

FIG. 4 is a bottom plan view of the rear ply of FIG. 3;

FIG. 5 is a top plan view of a front ply of a second embodiment of reuseable mailer according to the invention;

FIG. 6 is a top plan view of an insert ply of the second embodiment of mailer;

FIG. 7 is a top plan view of the rear ply of the second embodiment of mailer;

FIG. 8 is a top plan view of the front ply of the third embodiment of mailer according to the invention;

FIG. 12 is a top plan view of the front ply of a fourth embodiment of mailer according to the invention;

FIG. 13 is a top plan view of an insert ply of the fourth embodiment;

FIG. 14 is a top plan view of the rear ply of the fourth embodiment of reuseable mailer according to the invention; and FIG. 15 is a bottom plan view of the rear ply of FIG. 14.

DETAILED DESCRIPTION OF THE DRAWINGS

Figure 9:
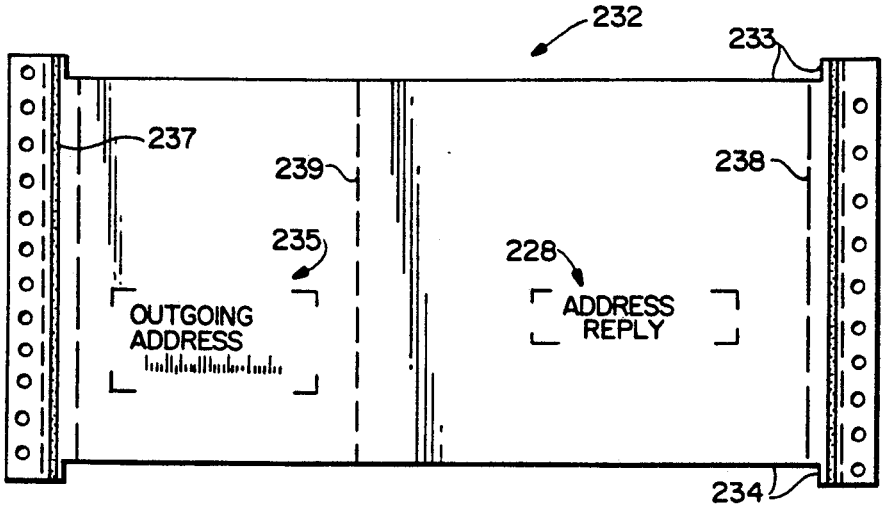
FIG. 9 is a top plan view of the insert ply of the third embodiment of mailer.
Figure 10:
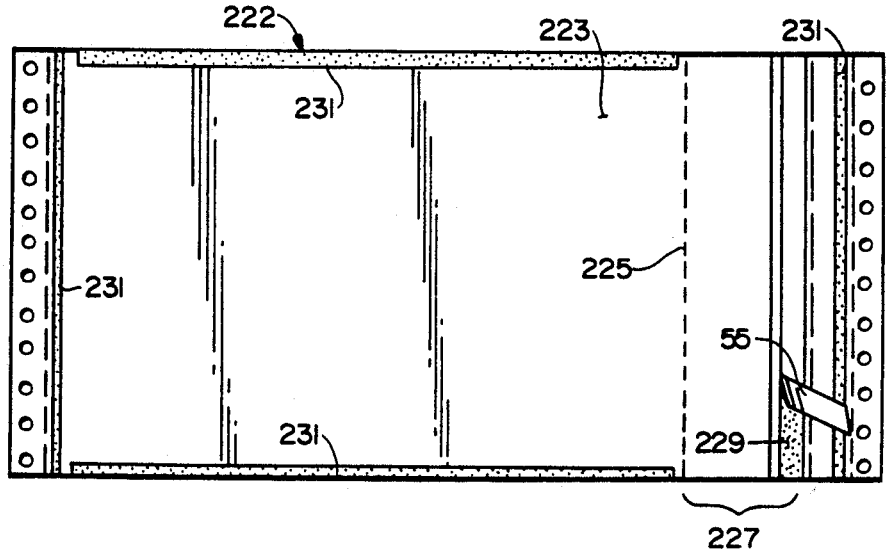
FIG. 10 is a top plan view of the rear ply of the third embodiment of mailer.
Figure 11:
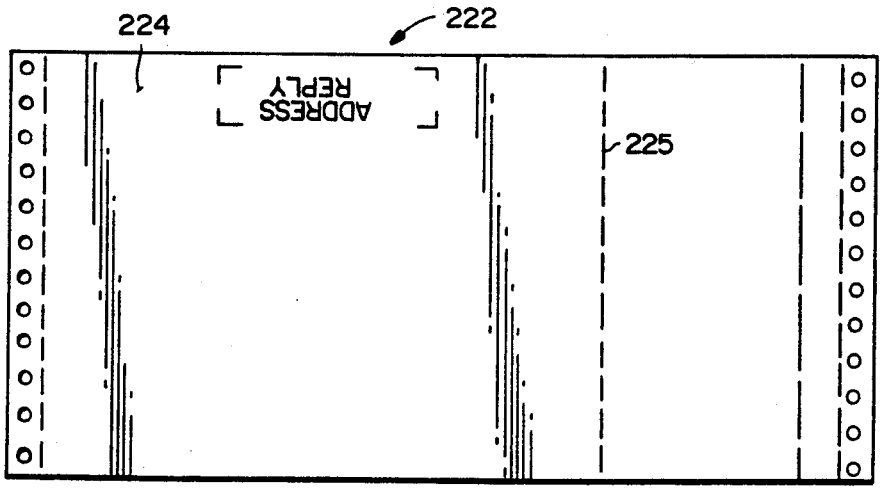
FIG. 11 is a bottom plan view of the rear ply of the third embodiment.

FIGS. 1 through 4 show a first embodiment of a reuseable mailer type business form according to the invention, shown generally by reference numeral 10 in FIG. 1, which is a top plan view of a front opaque ply 11 thereof. The mailer 10 is useable in an initial mailing configuration addressed to an outgoing addressee (the configuration illustrated in FIGS. 1 through 4), and in a reply mailing configuration addressed to a reply addressee. The manner in which the reply configuration is secured will be described more fully hereinafter.

The front ply 11 has a top edge 12, bottom edge 13, and side edges 14 and 15. In the upper right-hand corner is a first cutout 16, which may or may not be covered by a glassine (transparent) patch 17. A second cutout 18 is also provided, this cutout too optionally being covered by a transparent patch 19. A removable strip 20 is formed in the front ply 11 adjacent the bottom edge 13, the removable strip 20 being defined by a top perforation line 21 adjacent but spaced from the bottom edge 13.

The mailer 10 also includes a rear ply 22 (see FIGS. 3 and 4), also opaque, and of substantially the same size as the front ply 11. The rear ply 22 has a front face 23

(see FIG. 3) and a rear face 24 (see FIG. 4). A fold line 25 is provided in the rear ply 22 adjacent the bottom edge 26 thereof, but spaced from it, the fold line 25 being essentially coincident with the perforation line 21 from the overlying front ply 11. A flap portion 27 is defined between the fold line 25 and the bottom edge 26 of the rear ply 22.

Reply addressee indicia 28 (see FIG. 4) is printed on the rear face 24 of the flap portion 27 of the rear ply 22. The reply address 28 is upside down when viewing the rear ply 22 right-side up (as illustrated in FIGS. 3 and 4). An adhesive pattern, such as a rewettable adhesive strip 29 (see FIG. 3), or a strip of pressure sensitive adhesive covered by a release strip, is provided on the front face 23 of the flap portion 27, preferably adjacent the edge 26 as illustrated in FIG. 3. Indicia 30 is also preferably provided on the front face 23 of the rear ply 22 at the upper right-hand corner thereof (see FIG. 3) and visible through the first cutout 16 when the mailer 10 is in the reply configuration (with any inserts removed). The indicia 30 may be any indicia that indicates that postage should be applied to the mailer 10 when in the reply mailing configuration.

On both the inside face of the front ply 11, and the front face 23 of the rear ply 22, various glue strips 31 (see FIG. 3) may be provided for holding the components of the mailer 10 together. Spaced glue dots 31' (see FIG. 3) may be provided on the rewettable adhesive 29, for connecting plies 11, 22 together adjacent the bottom edge 13 thereof.

The mailer 10 also includes at least one insert ply 32 (see FIG. 2). The insert ply 32 is generally quadrate, like the plies 11, 22, and has substantially the same size, although preferably die-cut quadrates 33, 34 are provided along the top and bottom edges of the insert ply 32 which allow the front and rear plies 11, 22 to be connected directly to each other (as by the top edge of glue strip 31 seen in FIG. 3). On the insert ply 32 front face, visible through the second cutout 18, is the outgoing address indicia 35. Also, on the insert ply 32 is outgoing postage indicia, such as a meter stamp or a postage stamp, indicated by reference numeral 36 in FIG. 2, and visible through the cutout 16. Adhesive strips 37 may be provided adjacent the side edges of the insert ply 32 on both faces thereof for cooperating with like adhesive strips front and rear plies 11, 22, with perforation lines 38 provided just inwardly of the strip 37. Also, a line of weakness (e.g., perforation) 39 may be provided in the ply 32 just to the right of the outgoing address 35, the portion of the insert 32 to the right of the perforation 39 and to the left of the right-most perforation 38 forming a return card for the reply configuration of the mailer 10.

In conventional use of the mailer 10, the outgoing address 35 and the outgoing postage 36 are visible from the outside of the front ply 11 of the mailer 10, through windows 16, 18. Once the mailer 10 is received by the recipient, the removable strip 20 is detached. For this purpose, there may be conventional particularly configured corners, die-cuts, perforations, or the like, such as indicated by the corner 40 in FIG. 1. After the strip 20 is removed at the perforation 21, simultaneously removing any U.S.P.S. applied bar code 41, the insert 32 is detached at the perforations 38 and removed from between the plies 11, 22.

When ready to use the mailer for reply, the coupon to the left of the perforation 39 in FIG. 2 is inserted between the plies 11, 22, and the flap 27 is folded about fold line 25 so that rewettable adhesive 29 comes in contact with the front ply 11, covering up the second cutout 18. The adhesive 29 is wet, thereby sealing the flap 27 in place covering up the cutout 18, and with the reply address 28 now right-side up, and at approximately the same position in the reply mailer as the cutout 18 was in the outgoing mailer. Postage may be applied directly to the indicia 30 on the front face 23 of the rear ply 22, or may be applied at the outside of the glassine patch 17 covering the cutout 16. Thus, all of the original address information and postage information, including the U.S.P.S. required bar code 41, has been removed once the mailer is in the reply configuration.

It is noted that while the mailer 10 is shown in FIGS. 1 through 4 as having strips on the sides thereof with tractor drive openings 43 therein, typically those strips will be removed once the mailer is formed and before it is actually used (mailed).

A second embodiment of the mailer according to the present invention is shown in FIGS. 5 through 7. In the second embodiment structures generally comparable to those in the first embodiment will be illustrated by the same reference numeral only preceded by "1".

The mailer 110 front ply 111 has just one cutout 118 formed therein, through which the outgoing address 135—printed on the insert ply 132—is visible in the outgoing configuration of FIG. 5. In this embodiment the removable strip 120 is adjacent top edge 112, and removal of the strip 120 removes the original, outgoing postage indicia 136 which is printed on the front ply 111, as well as the return address 45 (it is noted that in the first embodiment no return address is provided on the front ply 11, but rather, it is the same as the reply address 28 formed on the rear face 24 of the rear ply 22).

In the second embodiment, the rear ply 122, front face 123 (see FIG. 7) has a rewettable adhesive 129 adjacent the top edge thereof, defining with the fold line 125 the flap portion 127. In this embodiment, a wide strip 47 of adhesive (see FIG. 7) is provided adjacent the bottom edge of the rear ply 122, and the cutout 134 in the bottom of the insert ply 132 is much larger than in the first embodiment. In fact, the adhesive 47 extends on both sides of a perforation line 48 formed in the rear ply 122, and aligned with the perf line 49, formed in the front ply 111.

Also in the FIGS. 5–7 embodiment, the reply address 128 may be printed on the front face of the rear ply 122, visible through the cutout 118 in the reply configuration. If this configuration is used, in order to ensure that the insert does not interfere with the reply address 128 visibility through the cutout 118, strips of self-stick adhesive 50, 51 (see FIG. 7 and 5, respectively) may be applied onto the front face of the rear ply 122 and the rear face (not shown) of the front ply 123, in alignment with each other and generally extending between the top and bottom edges 112, 113 (between the perforation lines 49, 121). Once the insert ply 132 is removed, the self-stick adhesive strips 50, 51—which may be latex adhesive—come into contact with each other and seal the left-hand interior of the reply mailer off from the right-hand interior. Thus, the return coupon between the perforation 139 and the right-most perforation 138 in FIG. 6 will fit in the right-hand side of the interior "pocket" formed by the plies 111, 122, and cannot shift over to mask the reply address 128.

In the use of the second embodiment, of FIGS. 5 through 7, the outgoing configuration is as illustrated in FIG. 5. When received by the recipient, the strip 120 is removed at the perf line 121, and the stub 53 formed in both the front and rear plies 111, 122 between the perf lines 49, 48, respectively, and the bottom edges of those plies, is detached. Removal of the strip 120 removes the outgoing postage 136 and the return address 145, while removal of the stub 53 removes the U.S.P.S. bar code 141. Note that the adhesive strip 47 is wide enough so that it still holds the front and rear plies 111, 122 together even after detachment of the stub 53.

To use the mailer 110 in the return configuration, one merely removes the insert ply 132 by detachment at the perforations 138, detaches the insert at the perf line 139, inserts the coupon portion to the right of the self-stick strips 50, 51 which adhere together, folds over the flap portion 127 and wets the rewettable adhesive 129, and puts postage on the upper right-hand corner of the reply configuration mailer (undoubtedly covering a part of the flap 127). The reply address 128 is clearly visible through the cutout 118.

A third embodiment according to the present invention is illustrated in FIGS. 8 through 11. Structures in this embodiment comparable to those in the FIGS. 1 through 7 embodiments are illustrated by the same two digit reference numeral, only preceded by a "2".

The FIGS. 8 through 11 embodiment is a modification of the traditional "grasp and snap" style mailer, opening along the right side. Aside from the fact that the perforation line 221 forms the removable strip 220 adjacent the right edge, rather than adjacent the bottom, front ply 211 in the third embodiment is similar to the front ply 111 in the first embodiment. Also, the cutout 218 preferably is substantially larger than the cutout 118, large enough so that the bar coding 241 and outgoing address 235 is visible through the cutout 218. The outgoing address 235 appears on the front face of the insert 232 (FIG. 9). In this embodiment, the flap 227, defined by the fold line 225, is also obviously on the right-hand side of the form, and in the structure actually illustrated in FIG. 10, the adhesive strip 229 on the flap portion 227 is pressure-sensitive adhesive covered by a piece of release paper 55. The reply address 228 is visible through the enlarged cutout 218 in the reply configuration of the mailer 210.

In the third embodiment of FIGS. 8 through 11, when the mailer 210 is received by the outgoing addressee, the addressee "grasps and snaps" the mailer, detaching the insert 232 from the front and rear plies 211, 222. Then the strip 220 is removed along the perforation 221, with it removing the outgoing postage 236. Then the coupon to the right of the perf line 229 in FIG. 9 is inserted between the plies 211, 222 so as to be visible through the enlarged cutout 218 (that is, the address 228 thereon is visible), then the flap portion 227 is folded about fold line 225, the release paper 55 is removed from the pressure-sensitive adhesive 229, and the adhesive 229 is brought into sealing contact with the front face of the front ply 211.

The fourth embodiment of the present invention is illustrated in FIGS. 12 through 15. The reuseable mailer, illustrated generally by reference numeral 310 in these figures, is similar to the first embodiment, except for the postage indicia and associated components for rendering the original postage indicia non-visible in the reply configuration. In FIGS. 12 through 15 structures comparable to those in the FIGS. 1 through 4 embodiment are shown by the same two digit reference numeral only preceded by a "3".

The front ply 311 has only one cutout 318. The outgoing postage 330 is provided directly on the front face of the front ply 311, on a removable side strip 60. The removable side strip 60 is used generally in place of the second window/cutout (i.e., 16) of the first embodiment. It is defined by a perforation line 61 spaced from the right edge 314 of the front ply 311.

Also in this embodiment, the insert 332 (FIG. 13) is somewhat shorter than the top and bottom plies 311, 322, and, of course, the flap 327 is also shorter because of the perf line 61, and its corresponding perf line 63 in the rear flap 322.

In use of the fourth configuration of FIGS. 12–15, when the outgoing addressee receives the mailer 310, both strips 320 and 60 are removed, and the insert 332 is removed, the insert 332 being attached only along one perf line 338, there being no corresponding perf line on the right side (see FIG. 13). The coupon is reinserted between the plies 311, 322, the flap 327 is folded over so that the adhesive 329 is in contact with the front face 323 of the rear ply 322, and the reply address 328 covers the cutout 318.

It will thus be seen that according to the present invention, four different specific embodiments of a reuseable mailer type business form have been described which are simple and easy to construct, yet comply with postage regulations since they all include means for rendering non-viewable all the outgoing addressee and postage information (including bar coding) when the mailer is converted between the initial configuration and the reply configuration.

While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent structures and products.

What is claimed is:

1. A reusable mailer type business form having an upper right hand corner, bottom left hand corner, and bottom, and useable in an initial mailing configuration addressed to an outgoing addressee, and in a reply mailing configuration addressed to a reply addressee, comprising:

a front opaque ply a first cutout in the upper right corner thereof, and a second cutout, and a removable strip at the bottom including a top perforation line, said second cutout being adjacent, and above, said top perforation line;

a rear opaque ply of substantially the same size as said front ply having a rear face and a front face, and a fold line adjacent the bottom substantially coincident with said top perforation line of said front ply, a flap portion defined between said fold line and the bottom, the flap portion having front and rear faces;

address indicia indicating the reply address for the reply addressee printed on said rear face of said flap portion of said rear ply, said address indicia upside down when viewing the rear opaque ply right-side up; and adhesive disposed on said front face of said rear ply flap portion; and at least one insert ply of substantially the same size as said front and rear plies, said insert ply having outgoing address information thereon visible through said second cutout when said mailer is in said initial mailing configuration, and outgoing postage indicia visible through said first cutout when said mailer is in said initial mailing configuration.

2. A business form as recited in claim 1 further comprising indicia formed at the upper right-hand corner of said front face of said rear ply, and visible through said first cutout when said insert ply has been removed, indicating that postage should be applied thereto when said mailer is in said reply mailing configuration.

3. A business form as recited in claim 2 wherein said adhesive is a strip of rewettable adhesive disposed adjacent the bottom of said rear ply.

4. A business form as recited in claim 1 wherein said flap portion has a dimension from said fold line to the bottom of said rear ply greater than the distance of the top of said second cutout from said perforation line so that when said flap portion is folded about said fold line with said adhesive contacting said front ply, said flap covers said second cutout.

5. A business form as recited in claim 1 wherein said cutouts are covered by transparent patches.

6. A business form as recited in claim 1 wherein said second cutout is near the bottom left hand corner of said front ply, and is covered by said reply address indicia when said flap portion is folded about said fold line with said adhesive contacting said front ply.

7. A reusable mailer type business form useable in an initial mailing configuration addressed to an outgoing addressee, and in a reply mailing configuration addressed to a reply addressee, comprising:

a front opaque ply having top, bottom and first and second side edges, at least one cutout, and at least one removable strip adjacent an edge thereof including a perforation line said perforation line extending parallel to said top and bottom edges and perpendicular to said side edges; and outgoing postage indicia visible at the upper right-hand corner of said front ply;

a rear opaque ply of substantially the same size as said front ply having a rear face and a front face, and a fold line adjacent an edge thereof substantially coincident with said perforation line of said front ply, a flap portion defined between said fold line and the adjacent edge of said rear ply;

at least one insert ply having outgoing address information thereon visible through said cutout when said mailer is in said initial mailing configuration; and means for rendering non-viewable all outgoing addressee and postage information, including outgoing addressee bar coding, when converting said mailer from said initial configuration to said reply configuration.

* * * * *